United States Patent [19]

Groves et al.

[11] Patent Number: 4,971,193

[45] Date of Patent: Nov. 20, 1990

[54] SYSTEM FOR INTRODUCING ADDITIVE INTO A CONTAINER

[75] Inventors: Michael H. Groves; Digby R. Redshaw; Michael R. Cane, all of Warwick, United Kingdom

[73] Assignee: Imperial Chemical Industries Public Limited Co., London, United Kingdom

[21] Appl. No.: 503,122

[22] Filed: Mar. 28, 1990

Related U.S. Application Data

[60] Continuation of Ser. No. 294,264, Jan. 3, 1989, abandoned, which is a division of Ser. No. 155,610, Feb. 12, 1988, Pat. No. 4,821,875, which is a continuation-in-part of Ser. No. 61,423, Jun. 12, 1987, Pat. No. 4,798,287.

[30] Foreign Application Priority Data

Feb. 12, 1987 [GB] United Kingdom ..... 8703205

[51] Int. Cl.[5] ..... B65D 25/08

[52] U.S. Cl. ..... 206/219

[58] Field of Search ..... 220/281, 282, 283, 265–267, 220/277–278; 366/150, 605; 206/219, 221; 215/250, 258, DIG. 8, 227; 141/349

[56] References Cited

U.S. PATENT DOCUMENTS

| | | | |
|---|---|---|---|
| 2,524,366 | 10/1950 | Smith | 206/221 |
| 2,524,607 | 10/1950 | Smith | 206/221 |
| 2,528,530 | 11/1950 | Machleder | 366/605 X |
| 2,677,459 | 5/1954 | Ritzenberg | 206/222 |
| 2,696,337 | 12/1954 | Dinhofer | 141/349 |
| 2,719,628 | 10/1955 | Ivanoff | 206/221 |
| 2,819,738 | 1/1958 | Marberg | 366/605 X |
| 3,347,410 | 10/1967 | Schwartzman | 206/222 X |
| 3,439,823 | 4/1969 | Morane | 206/221 |
| 3,521,745 | 7/1970 | Schwartzmann | 206/47 |
| 3,720,523 | 3/1973 | Nakagami | 99/171 |
| 4,386,696 | 6/1983 | Goncalves | 215/258 X |
| 4,401,225 | 8/1983 | Schwaikert | 220/281 X |
| 4,570,826 | 2/1986 | Fattori . | |
| 4,727,985 | 3/1988 | McNeirney et al. | 215/DIG. 8 |

FOREIGN PATENT DOCUMENTS

| | | | |
|---|---|---|---|
| 46546 | 11/1968 | Australia . | |
| 52310 | 10/1979 | Australia . | |
| 0014805 | 9/1980 | European Pat. Off. . | |
| 24410406 | 3/1975 | Fed. Rep. of Germany | 215/DIG. 8 |
| 3152033 | 7/1983 | Fed. Rep. of Germany . | |
| 2153767 | 5/1973 | France . | |
| 2453793 | 7/1980 | France . | |
| 188478 | 3/1982 | New Zealand . | |
| 201457 | 12/1985 | New Zealand . | |
| 1107863 | 8/1984 | U.S.S.R. | 206/219 |
| 303806 | 2/1930 | United Kingdom . | |
| 647146 | 12/1950 | United Kingdom . | |
| 834577 | 5/1960 | United Kingdom . | |
| 1131193 | 10/1968 | United Kingdom . | |
| 1211168 | 11/1970 | United Kingdom | 215/250 |
| 1512013 | 5/1978 | United Kingdom . | |
| 1539598 | 1/1979 | United Kingdom . | |
| 1548312 | 7/1979 | United Kingdom . | |
| 2021513 | 12/1979 | United Kingdom | 206/219 |
| 2108464 | 5/1983 | United Kingdom . | |

*Primary Examiner*—William I. Price

*Attorney, Agent, or Firm*—Cushman, Darby & Cushman

[57] ABSTRACT

A system for introducing a flowable additive (3) from a capsule (1) to paint (4), varnish, woodstain or the like in a closed (preferably lidded) container (2) (for example a paint container) modified by the provision of a relatively easily openable inlet (9) into the container. Preferably the inlet is located in a lid (6). The Capsule comprises a chamber (23) which defines a volume which contains the additive. The system is provided with means (25 and 34) for creating an opening in the chamber which can communicate with the inlet and means (preferably a compressible chamber) for positively expelling additive through the opening by contracting the volume which contains the additive. The capsule and container are also provided with co-operable locating means (10 and 30 with 25) which can co-operate to assist in locating the opening created in the chamber in communication with the inlet. Also a capsule and a closed container for use in the system and a method of introducing additive using the system. Use of the system reduces the risk of spillage and splashing and permits more controlled tinting of paint and therefore is more suitable for use by inexperienced people.

16 Claims, 15 Drawing Sheets

Figure 1:
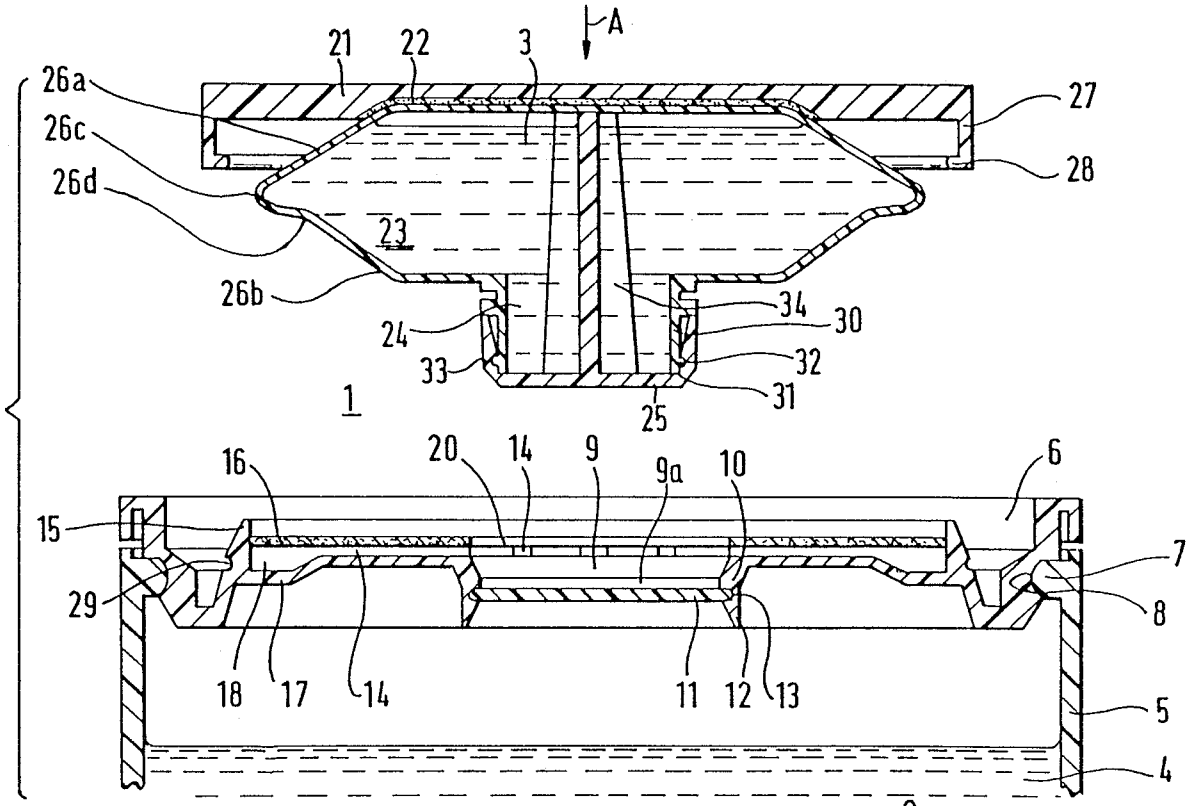

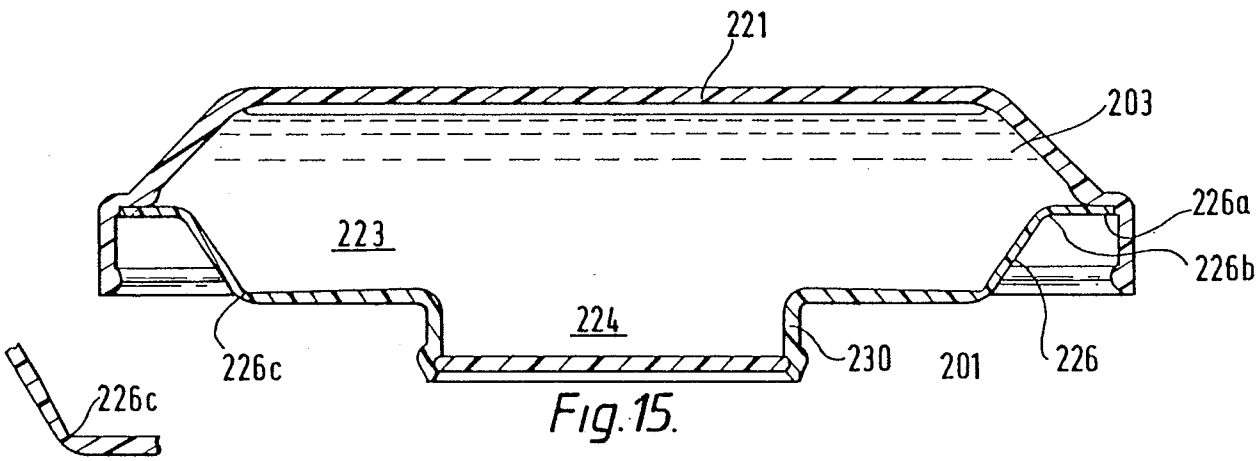
Fig. 15.
Fig. 15a.
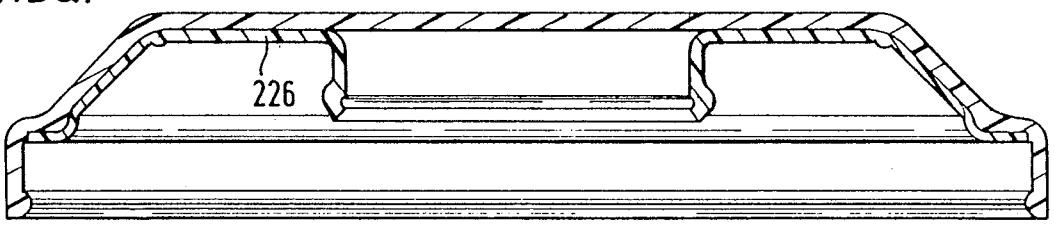
Fig. 16.

SYSTEM FOR INTRODUCING ADDITIVE INTO A CONTAINER

This is a continuation of application Ser. No. 07/294,264, filed Jan. 3, 1989 (abandoned in favor hereof), which was a division of application Ser. No. 07/155,610, filed Feb. 12, 1988 (now U.S. Pat. No. 4,821,875, issued Apr. 18, 1989), which was a continuation-in-part of application Ser. No. 07/061,423, filed June 12, 1987 (now U.S. Pat. No. 4,798,287, issued Jan. 17, 1989).

This invention relates to a system for introducing flowable additive to paint, varnish, woodstain or the like contained in a closed (preferably lidded) container. "Paint" includes traditional paints based on organic solvents and also paints based on aqueous solvents many of which are known as emulsion or latex paints. The additive may be any material which can be caused to flow well enough to enable it to be introduced into the container. The invention especially relates to a system for introducing a dose of (usually liquid or semi-solid) colourant to a base paint contained in a lidded paint can and which system is suitable for use in retail shops or stores which supply tradesmen. Such introduction of colourants into paint in shops or stores is often known as "in-store tinting". In-store tinting allows a much wider range of colors to be offered than would be possible if cans of each individual colored paint had to be stocked. This is because the space which would be needed to stock a large number of colored paints is much greater than the space needed to stock cans of base paint and an equivalent number of doses of colourant. Other additives which can be introduced to paint, varnish or woodstain using the system include fungicides, foaming agents, rheology modifiers, components (usually a catalyst or accelerator) of a multi-component paint or varnish or additives which modify the appearance of a paint such as flowable particulate solids such as solids which impart texture to a paint or metal flakes always provided such solids can be made to flow.

Hitherto in-store tinting has usually involved removing the lid from the can (or even punching a hole in the lid), introducing the correct dose or doses of colourant into the can, replacing the lid (or plugging the hole) and finally shaking the can in a mechanical shaker to disperse the colourant. Removal of the lid creates an opportunity for the paint, varnish or woodstain to be spilled or splashed and so this type of tinting technique is generally inconvenient and not very suitable for use by inexperienced people, especially members of the public in self-service shops. Punching a hole in the lid requires the skilled use of a sharp tool and so it is a technique which is quite unsuitable for use by inexperienced people. A further difficulty is that care is needed to ensure that the correct dose of additive is introduced into the container. This is especially so when the additive is a colourant because the eye is very sensitive to variations in shade caused by a failure to add all of the colourant. The amount of care needed can be reduced by supplying measured doses of additive in capsules but even then care is still needed to avoid spillage and splashing. Care is also needed to ensure that a capsule is properly emptied. One object of this invention is to provide a system for introducing additive from a capsule into a container which involves less risk of spillage and splashing. Another object is to minimize the care needed in ensuring that the capsule is properly emptied.

An object of a refinement of the invention is to provide a system especially suitable for use by inexperienced members of the public. An object of another refinement is to provide a system which allows a container into which additive has been introduced to be safely shaken in a mechanical shaker.

Accordingly this invention provides a system for introducing flowable additive to paint, varnish, woodstain or the like contained in a closed (preferably lidded) container wherein the system comprises (a) a closed container containing the paint, varnish, woodstain or the like provided with an inlet closed by a closure but which inlet is openable by a force exerted on the closure (b) a closed capsule separate from the closed container, which capsule comprises a chamber which houses a volume which contains the flowable additive, (c) means carried by the container or (preferably) by the capsule for use in creating an opening in the chamber which opening can communicate with the inlet into the container and (d) means for use in positively expelling additive from the chamber through the opening by contracting the volume housed by the chamber and wherein the container and capsule are provided with co-operable locating means which can at least assist in locating the opening created in the chamber in communication with the inlet into the container. Opportunities for loss of additive by spillage and splashing are substantially reduced by the use of an inlet (i.e. the "container inlet") which is specifically designed to be openable to communicate with an opening created in a capsule chamber (i.e. the "chamber opening") together with the use of co-operable locating means which assist in locating the chamber opening in communication with the container inlet. The risk of significant amounts of additive being left in the capsule by inexperienced members of the public is minimized by the provision of means for positive expulsion of the additive from the chamber. This is especially important during in-store tinting in order to avoid variations in shade which can arise if not all the colourant is added to a basepaint. This invention also provides a combination comprising the closed container and the closed capsule, as defined above wherein the locating means are in co-operation and so at least assist in locating the chamber opening in communication with the container inlet. Preferably the means for creating an opening in the chamber (i.e. the "chamber opening means") is actuated by the exertion of an external force on the capsule which force acts in a direction which is inwards of the container. Also the chamber opening means should preferably be operative only during and/or after the opening of the container inlet so that additive expelled from the chamber can immediately pass into the opened container. This further reduces the opportunities for spillage from the capsule chamber and therefore makes the system especially suitable for use by inexperienced members of the public. Preferably the means for positively expelling additive from the chamber by contracting the volume which contains the flowable additive (i.e. "the positive expulsion means") comprises a compressible chamber which is compressible by the exertion of a force on the exterior of the capsule. In an especially preferred system, the positive expulsion means comprises a chamber which is compressible preferably in response to a force exerted on a portion of the capsule which is remote from the container so that the positive expulsion means can be operated by compressing the chamber in a direction which is inwards of the container. It is also preferred that the force which compresses the chamber, the force which operates the chamber opening means and the force which opens the inlet, should all act inwards of the container and along the same line because then the forces needed to operate the system can be conveniently supplied by opposed clamping members of a mechanical shaker. If the closed container is lidded, it is preferred that the container inlet should be formed in the lid and should be openable by a force acting inwards of the container because then the force which opens the inlet will act in a direction which urges the lid inwards of the container and so does not loosen or remove the lid from the container.

The co-operable locating means provided on the container and capsule preferably comprise a recess and a projection both dimensioned such that the recess can receive the projection. Preferably the recess should be formed in the closed container (especially in a container lid) and the projection should extend from the capsule. An especially preferred system comprises firstly a recess formed in the container which recess leads to the inlet closure and secondly a co-operable projection on the capsule which comprises an outlet through which additive can be expelled from the capsule. Receipt of the projection into the recess further reduces the opportunities for spillage and splashing. Preferably when the projection is centrally located within the recess, the maximum clearance between the projection and the recess should not exceed 4 mm and if possible the projection should make a close fit in the recess in order to give a more positive location of the chamber opening in communication with the inlet. The inlet may comprise for example a skirt (i.e. the "inlet skirt") which extends into the container and which is closed by a closure located at the distal end of the skirt so as to define a blind recess which can receive a projection on the capsule. Preferably the projection on the capsule comprises a preformed outlet dependent from the chamber and closed (preferably at its distal end) by a displaceable closure which can be displaced to create the opening in the chamber.

The container inlet can be closed by a closure (for example a screw-cap or an adhesive pull-tab) which requires a rotational force or a force exerted in a direction outwards of the container in order to remove the closure and open the inlet. However (unless complex removal means are employed) such closures have the serious disadvantage that they need to be removed before the capsule can be located on the container and this, of course, creates a momentary opportunity for spillage. Moreover, if the container inlet is formed in a lid, the exertion of an excessive outwards force on the inlet closure may loosen or even remove the lid. Therefore it is preferred to use an inlet closure which is openable by a force exerted in a direction inwards of the container. Such a closure may be integral with the inlet. The opening of an inlet closed by an integral closure could be performed by means of a rupturing action, for example a rupturing (especially a puncturing) action imparted by a relatively sharp tool, for example a cutting edge or spike. Rupturing actions can be unpredictable and they also require the use of potentially harmful sharp tools. Therefore there are advantages in having a closure which is formed separately from the inlet and which is then engaged on the inlet by means which disengage in a relatively predeterminable way without needing the use of a sharp tool. Hence the inlet can be opened by disengaging and displacing the closure rather than by rupturing it. Examples of such predeterminable disengagement means include a frangible layer of adhesive, a frangible weld, a press fit or a snap-action fit.

The opening in the capsule chamber may likewise be created by rupturing a closure provided on a preformed outlet to the chamber (i.e. the "outlet closure"). Rupturing may be performed using opening means which comprise a sharp tool (a cutting edge or spike) carried on the container. However again because rupturing actions can be unpredictable, it is preferred to provide the chamber with a preformed outlet closed by an outlet closure formed separately from the chamber and engaged on the outlet by means which can be disengaged in a relatively predeterminable way, for example those types used to engage the inlet closure. The chamber opening is then created by disengaging and displacing the outlet closure. The disengaging and displacing means may comprise an arm carried on the outlet closure which arm extends inwardly of the chamber towards (and preferably touches) the portion of the chamber wall lying opposite the closure so that a compressing force exerted on that portion can be transmitted via the arm and exerted on the closure as both a disengaging force and a displacing force. Alternatively it has been discovered that the hydraulic pressure generated by compressing a compressible chamber is usually sufficient to disengage and displace a frangibly attached or snap-fitting outlet closure and so no additional engagement means may be needed. It is preferred that a preformed outlet on the chamber should comprise a skirt (i.e. the "outlet skirt") which is dimensioned so as to be receivable by the inlet skirt whereby the outlet skirt can serve as a locating projection. Preferably the outlet skirt is long enough to penetrate far enough towards the closed inlet to enable a force exerted on the capsule to be transmitted via the skirt and exerted on the inlet closure in order to open the inlet. Alternatively, the distal end of the dependent outlet skirt may be provided with a displaceable closure of a type which carries an arm so that a force which opens the container inlet can be transmitted from the capsule via the arm to the inlet closure. The distal end of the arm may be provided with a stop (for example a barb) which comes up against the chamber outlet as the outlet closure is displaced and thereby prevents the arm from falling into the paint.

A capsule chamber which is compressible preferably comprises at least some walls composed of a flexible material, for example a plastics foil or an injection molded thin plastics web. In order that the chamber be compressible in a predetermined way, it is preferred to provide at least one line of weakness and/or an angled portion of wall which extends at least part and preferably all of the way around the chamber. Preferably a line of weakness comprises a thinning of the flexible material. An angled portion may be molded into the flexible material or it may comprise a crease or it may be made by welding. Preferably the chamber has a shape in the form of two opposed adjacent dishes joined around their perimeters. This double dish shape assists in achieving a high degree of expulsion of additive when the chamber is fully compressed. It may also be useful for the dish which is to be nearest the container to be formed with a concave curved portion adjacent its perimeter, that is to say nearer to its outermost perimeter than to its center. It has been found that such a concave portion can co-operate with suitably shaped surfaces in the system to cause the double dish shape to collapse on compression of the chamber in such a way that the dishes exert a force which propels additive towards a central opening in the chamber. This propelling force is especially useful when the additive comprises particles of solid which do not flow easily. A preferred double dish container comprises a relatively rigid upper dish bonded (preferably welded) to a lower dish which comprises a flexible molded thin web. Making the lower dish by injection molding enables the thickness of the thin web to be precisely controlled and in particular it enables a line of weakness comprising a thinning of the web to be molded into the dish. It also facilitates the molding of an outlet skirt or other dependent projection integrally with the dish.

If all the walls of the chamber are flexible, (which is often the case when the chamber is made by blow molding),it is preferred that the capsule should also comprise a relatively rigid member attached to (preferably adhesively bonded to) a portion of the chamber wall against which a force is to be exerted. The rigid member serves to distribute force over that portion of the chamber wall.

In addition to the co-operable locating means, it is also preferred that the container and the capsule be provided with co-operable sealing means which can co-operate to provide a replacement closure for the container inlet so as to prevent spillage from the container after the original inlet closure has been displaced. Surprisingly, the sealing means for a system comprising a resilient lidded plastics container may for example comprise inlet and outlet skirts which are dimensioned so that one makes a sealing press fit within the other even though a sealing fit ought to create difficulties by preventing the escape of air displaced TM from the container by the introduction of the additive. However it has been discovered that a lidded resilient plastics container can allow escape of displaced air by means of a forced leak between the lid and its seating. Alternatively the skirts may comprise inter-engageable snap-action profiles which can co-operate to make a sealing snap-fit. Additionally or alternatively the sealing means may comprise a (preferably resilient) rim which depends from the capsule and extends around the chamber opening and which is adapted to make a snap fit in a co-operable sealing means provided on the container and which extends around the inlet. Preferably the snap action is provided by a rib receivable in a groove. It is preferred that the sealing means are so positioned that they only co-operate to provide the replacement closure after the inlet has been opened and after expulsion of the additive into the container has terminated so as to facilitate the escape of any air displaced from the container. The container may be provided with one or more catchment cavities arranged around and in communication with the container inlet. These cavities serve to trap material which may be splashed and carried out through the inlet by the escaping air although this is not a serious problem where a projection makes a close fit in the inlet.

Flexible material used in making a compressible chamber may be preferably a foil of polyethylene terephthalate or a web of injection molded polypropylene including polypropylene modified by the presence of added rubbery material or copolymerised ethylene. Other components of the capsule and the container are preferably made from a tough resilient thermoplastics material, especially a crystalline polyolefine such as polyethylene, polypropylene or the rubber or ethylene modified polypropylenes mentioned above. Modified polypropylenes are especially suited to making lidded containers because their resilience facilitates the forced leakage of air around the lid. To avoid accidental opening of the container inlet or the capsule chamber, it is preferred that a force greater than that which can be applied by the unaided finger or thumb (for example a force of at least 0.05 kN) be required to open the inlet. Preferably the force needed to create an opening in the chamber should not exceed 3 kN and usually a force of 0.4 to 1.3 kN is most suitable.

Figure 2:
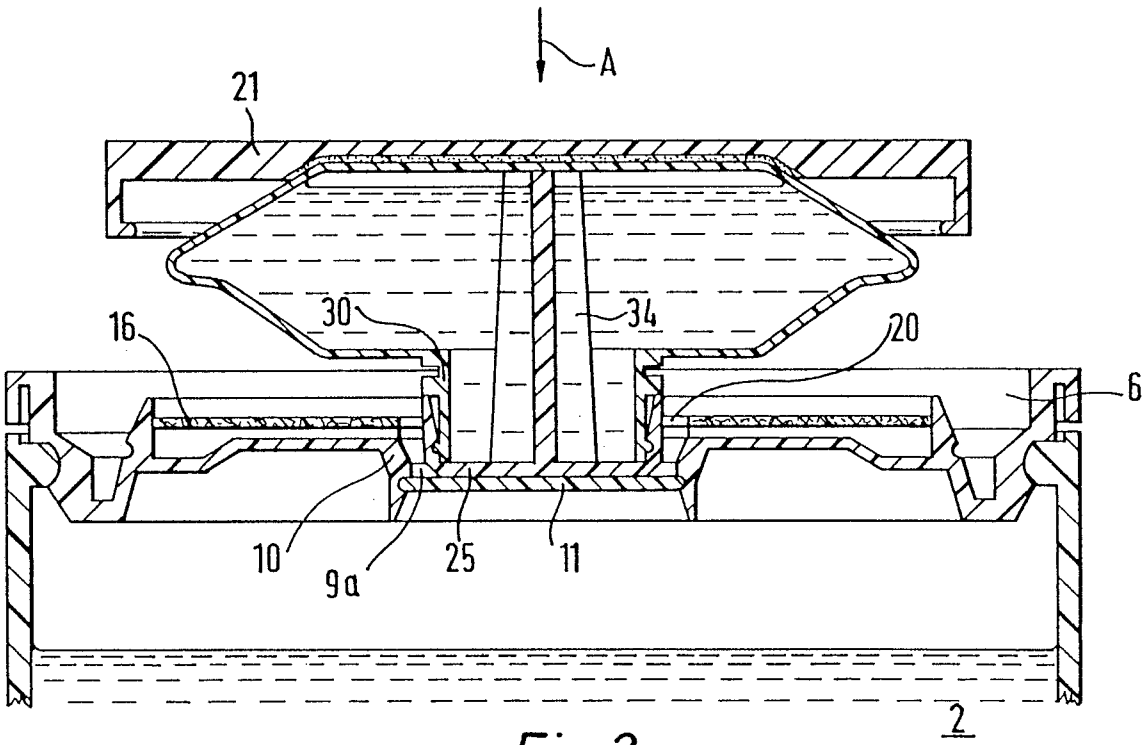
Figure 3:
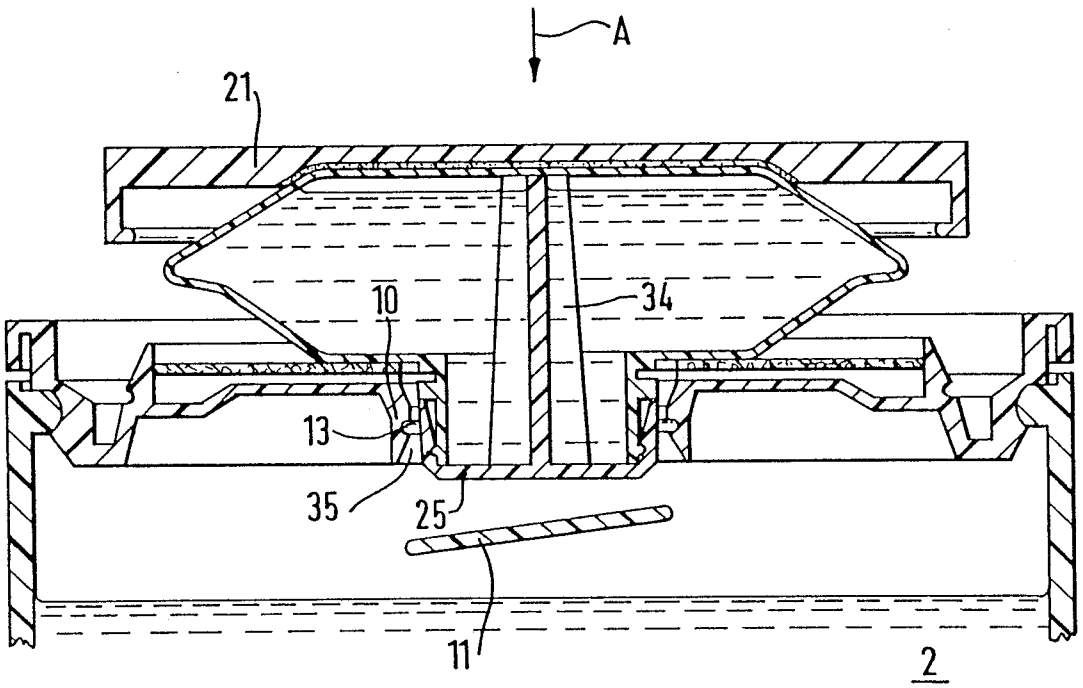
Figure 4:
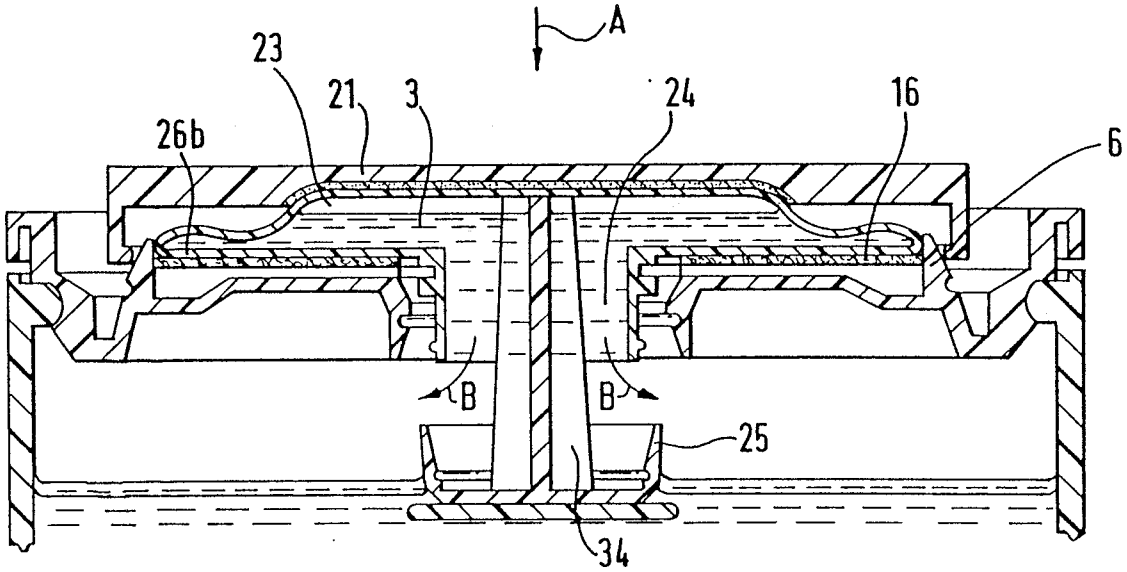
Figure 5:
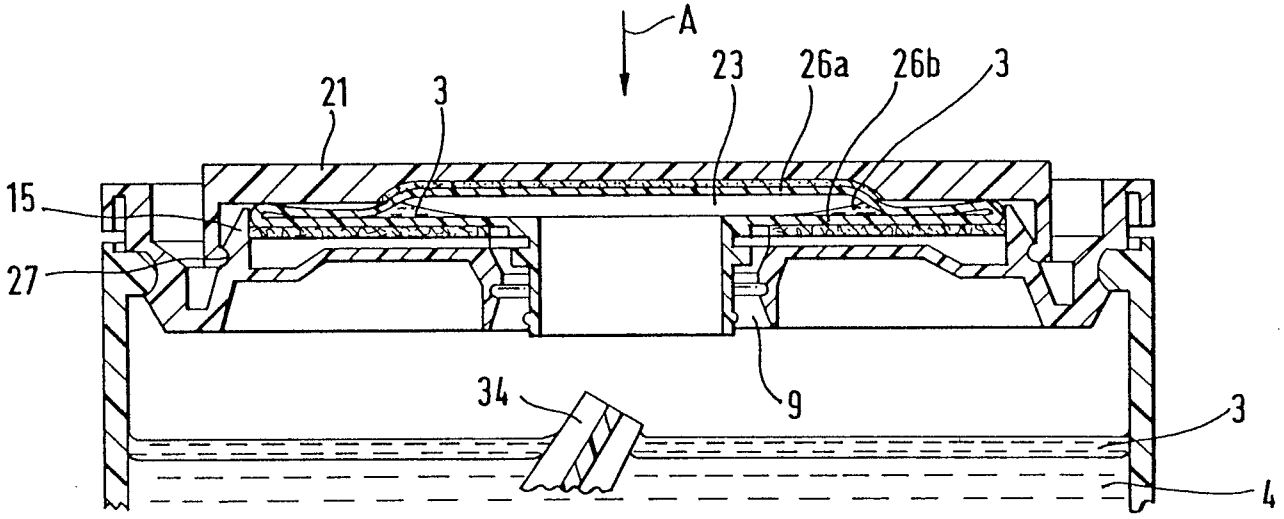

The invention is further illustrated by the following preferred embodiments which are described with reference to the drawings of which FIG. 1 is a section of a system according to this invention and shows a capsule and part of a container, FIG. 2 is a section of the container of FIG. 1 shown receiving the capsule of FIG. 1, FIG. 3 is a section of the container and capsule shown in FIG. 2 but after the container inlet closure has been opened, FIG. 4 is a section of the container and capsule shown in FIG. 3 but after the capsule chamber has been compressed and the volume containing the additive contracted, FIG. 5 is a section of the container and capsule shown in FIG. 4 but after the sealing means have co-operated to provide a replacement closure for the container inlet.

Figure 6:
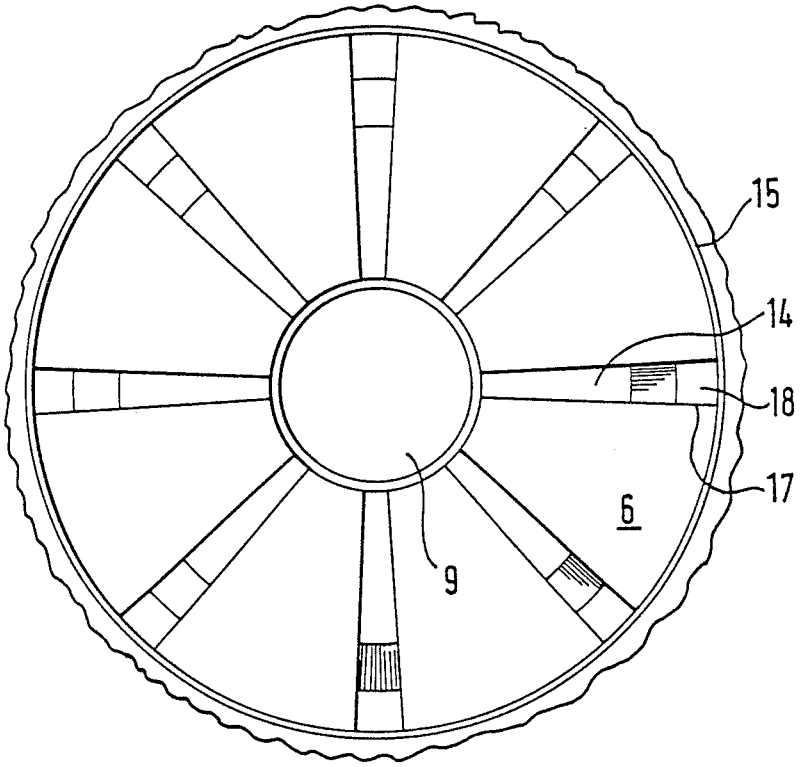
Figure 7:
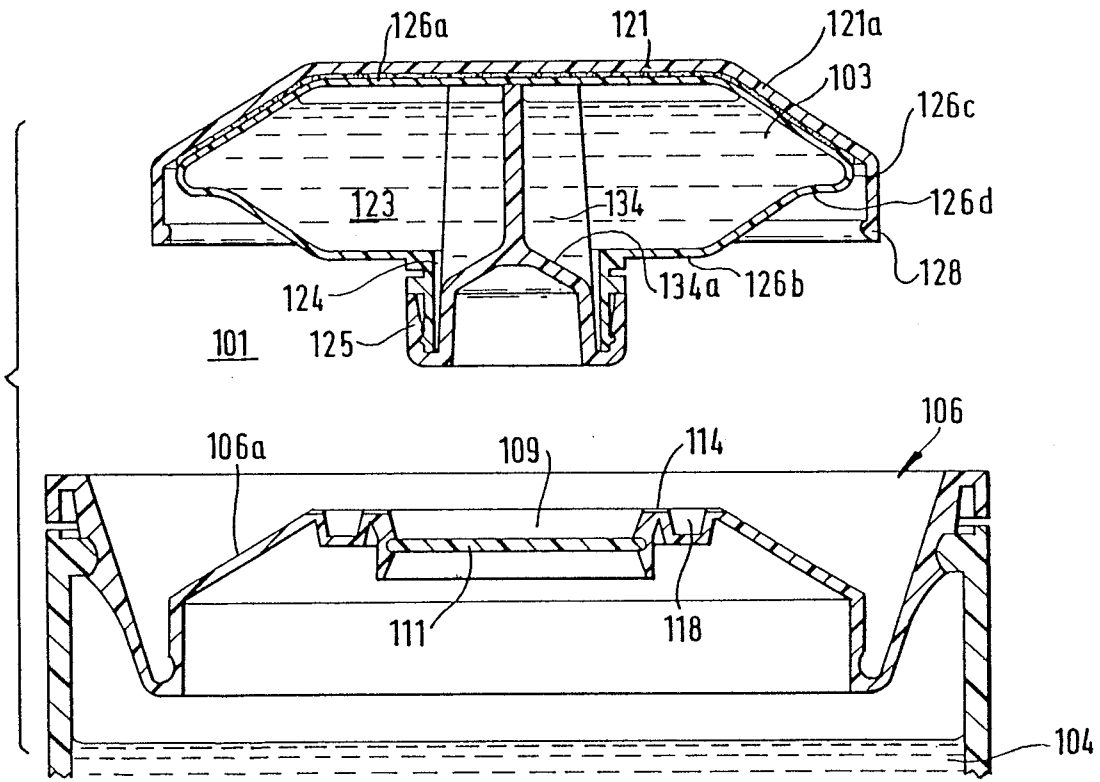
Figure 8:
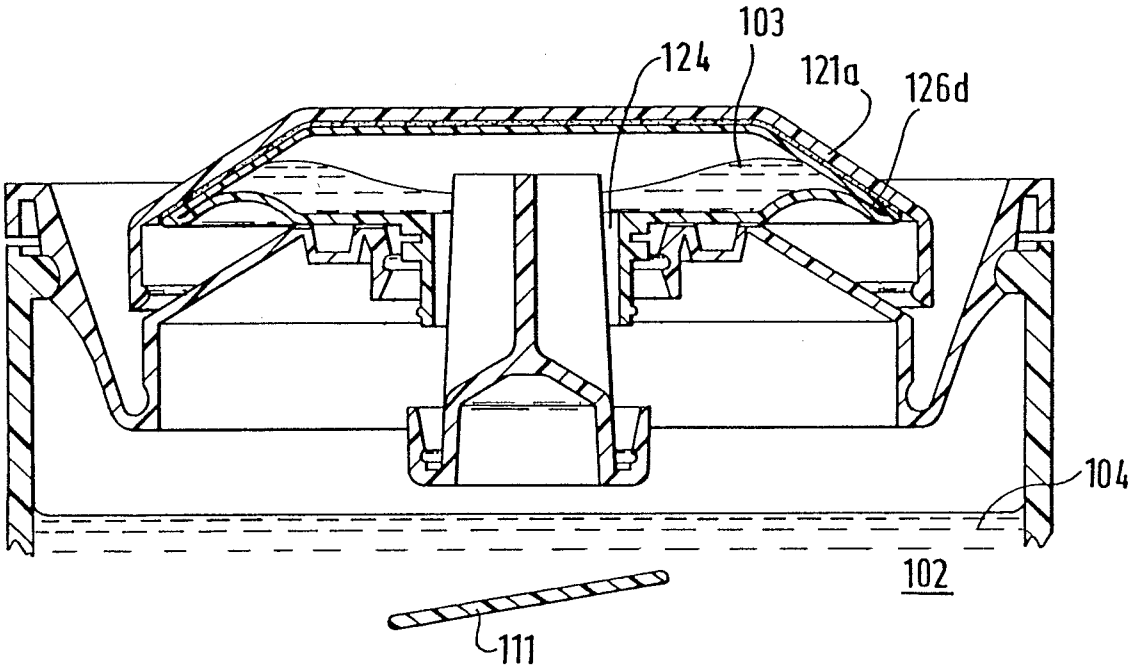
Figure 9:
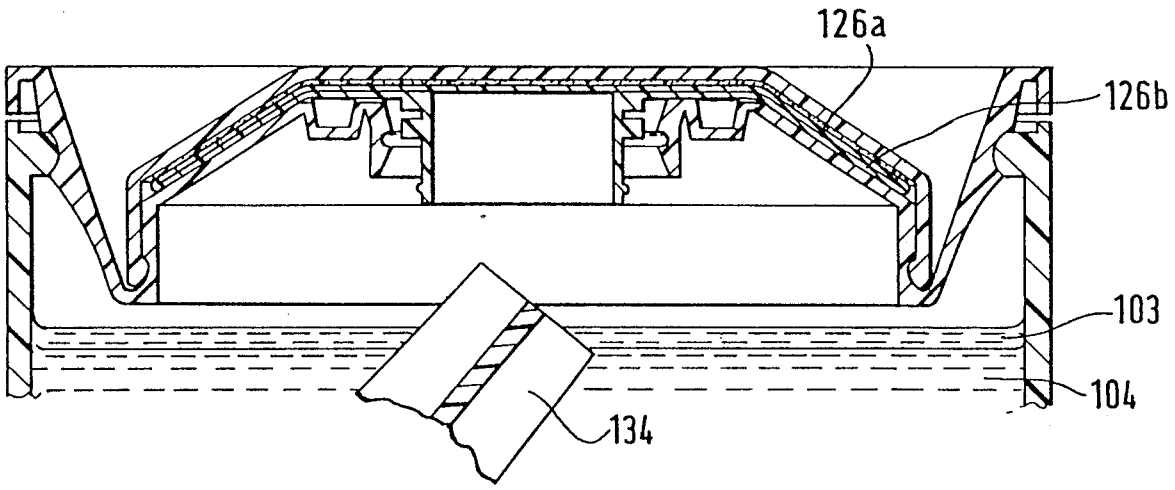
Figure 10:
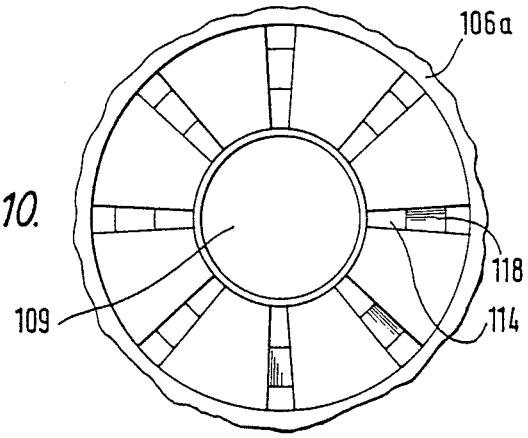
Figure 11:
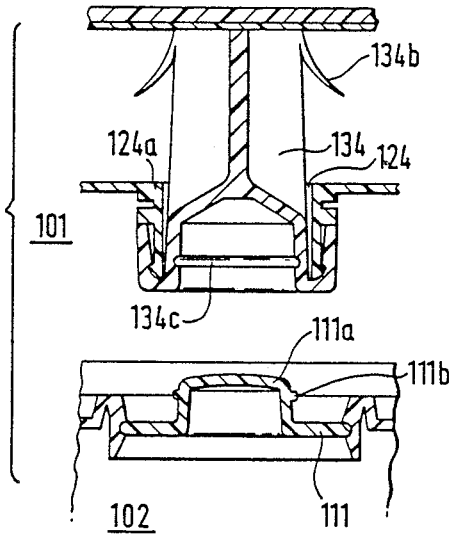
Figure 12:
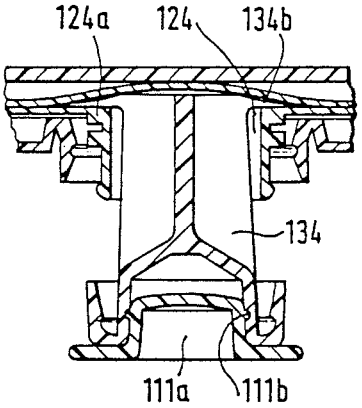
Figure 13:
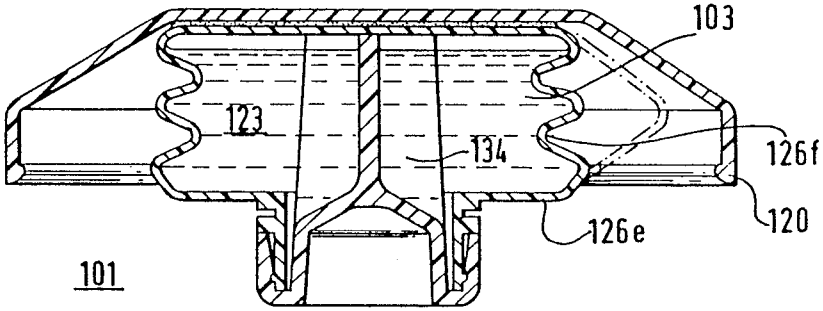
Figure 17:
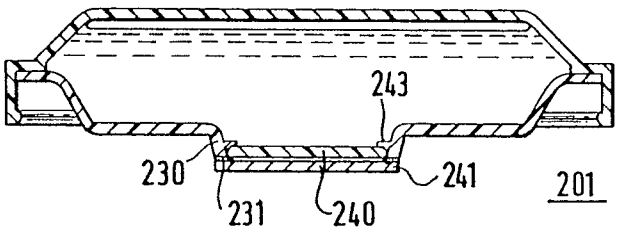
Figure 14:
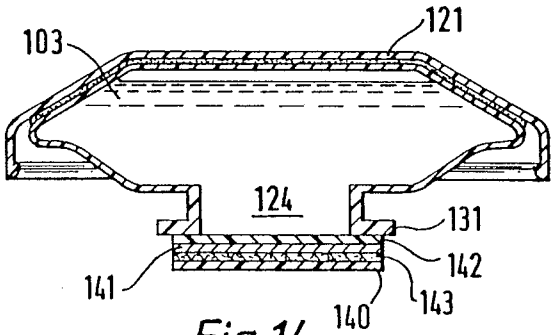
Figure 21:
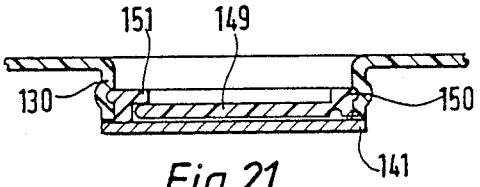
Figure 22:
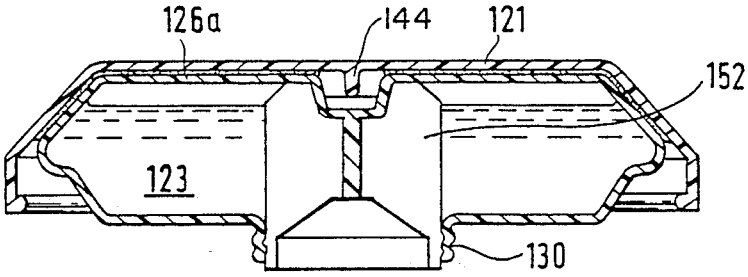
Figure 23:
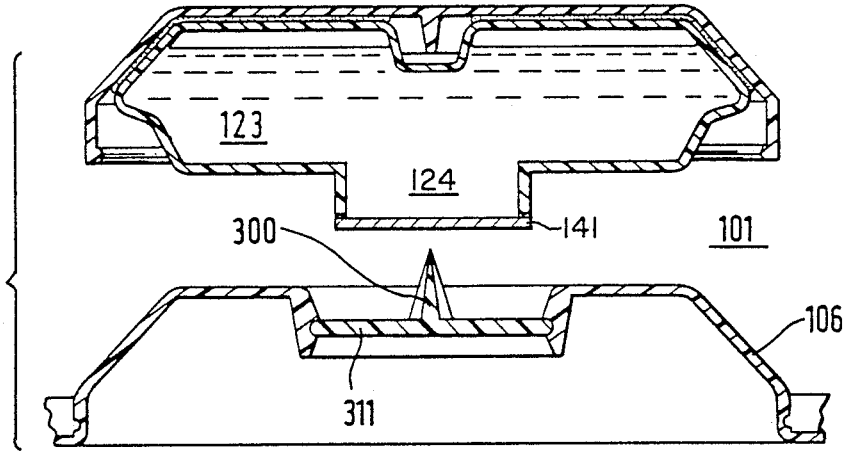
Figure 24:
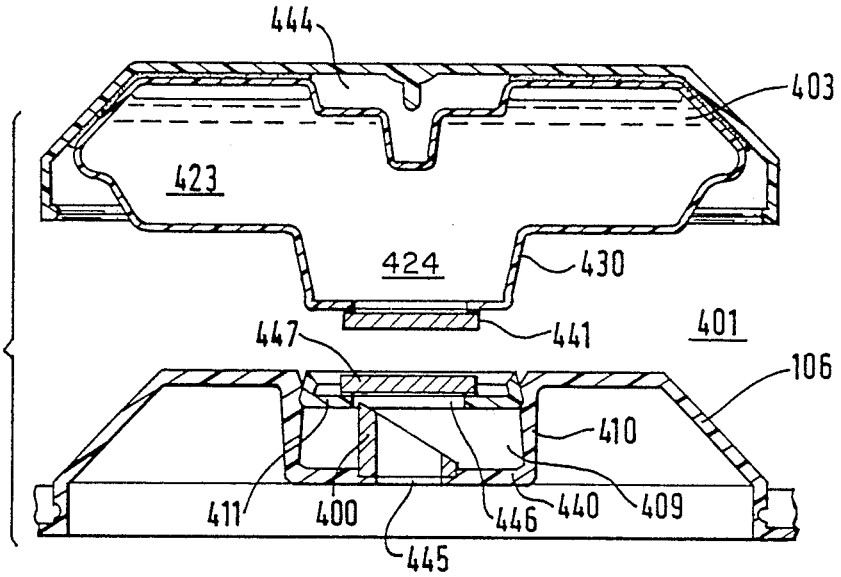
Figure 25:
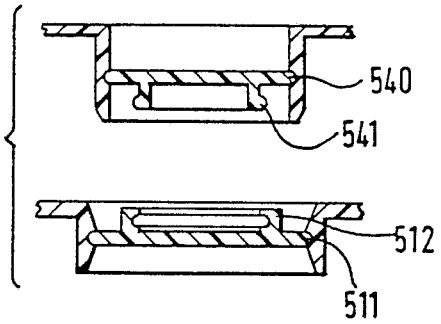

FIG. 6 is a plan of a central fragment of the lid shown in FIGS. 1 to 5 and omitting disc 16, FIG. 7 is a section of an alternative system according to this invention and shows a capsule and part of a container, FIG. 8 is a section of the container of FIG. 7 shown receiving the capsule, FIG. 9 is a section of the container and capsule of FIG. 7 showing the capsule finally in place on the container, FIG. 10 is a plan of a central fragment of the lid shown in FIG. 7, FIG. 11 is a section of a central fragment of a system of the type shown in FIG. 7 but having a modified opening means and inlet closure, FIG. 12 is a section showing the fragment of FIG. 11 when the opening means is fully advanced into the container, FIG. 13 is a section of an alternative capsule, FIG. 14 is a section of a capsule having an alternative closure arrangement, FIG. 15 is a section of a further alternative capsule, FIG. 15*a* is a fragmentary cross-sectional view of the hinge portion of the structure shown in FIG. 15, FIG. 16 is a section of the capsule of FIG. 15 but shown after the capsule chamber has been compressed, FIG. 17 is a section of a further alternative capsule and closure, FIG. 18 to 22 are sections of alternative closures for a capsule, FIG. 23 & 24 are sections of parts of systems which use a sharp tool to create an opening and FIG. 25 is a section of an outlet and an inlet closure provided with uniting means.

FIG. 1 shows a system comprising a capsule 1 and a closed container 2 which system is suitable for introducing semi-solid colourant 3 from chamber 23 to paint 4 contained in closed container 2. Container 2 consists of a polypropylene paint can 5 on which is engaged a plastics lid 6 by means of a liquid-tight snap fit provided by circumferential seating rib 7 which engages circumferential groove 8.

Lid 6 is provided with a circular closed inlet 9 having an inlet skirt 10 which extends inwardly of closed container 2 and defines a recess 9a. Inlet 9 is closed by a plug 11 engaged on distal end 12 of inlet skirt 10 by means of a fluid-tight snap fit into circumferential groove 13. Plug 11 therefore makes recess 9a blind. Lid 6 is also provided with an upstanding circular flange 15 and a stiff cardboard bridging disc 16 containing hole 20. Disc 16 serves to provide a surface which can carry printed instructions for the operation of the system. Lid 6 further provides eight radial troughs 14 and associated rebates 17 equally spaced around inlet 9 (see FIG. 6) and which co-operate with bridging disc 16 to define a catchment cavity 18 which traps any droplets of colourant 3 and/or paint 4 carried through inlet 9 by displaced air escaping from container 2.

Capsule 1 is composed of circular rigid plastics cover 21 bonded by layer 22 of adhesive to compressible central circular chamber 23 which contains colourant 3 and which is provided with a circular chamber outlet 24 closed by a circular cap 25. Chamber 23 is formed by two opposed dished portions 26a and 26b of flexible polyethylene terephthate foil which join at circumferential angled portion 26c at the outermost perimeter of the chamber to define a volume which contains colourant 3. Angled portion 26c helps to predetermine the way in which chamber 23 compresses to contract the volume in which the additive is contained. Lower dished portion 26b is formed with a concave curve 26d adjacent angled portion 26c. Cover 21 serves both to distribute any force applied to the top of capsule 1 over upper dished portion 26a of chamber 23 and to provide a mounting for resilient dependent annular rim 27. Rim 27 is adapted to provide part of a sealing means by the provision of circumferential rib 28 which can engage a co-operable circumferential groove 29 formed in flange 15 on lid 6 so as to provide a fluid-tight snap fit. Chamber outlet 24 has circular projecting dependent outlet skirt 30 whose diameter is small enough even when closed by cap 25 to be received with a clearance fit into blind recess 9a. The clearance see FIG. 2, is 1 mm. Accordingly, outlet skirt 30 when closed by cap 25 and inlet skirt 10 can assist in locating the opening to be created in chamber 23 in communication with inlet 9. The opening will be created by disengagement of cap 25 from skirt 30.

Cap 25 closes distal edge 31 of outlet 24 by means of a fluid-tight snap fit formed by the engagement of circumferential lug 32 in circumferential recess 33. Cap 25 is formed with an integral arm 34 which extends back into chamber 23 and abuts upper dished portion 26a so that a compressive force exerted on upper dished portion 26a is transmitted downwards by arm 34.

To use the system, closed chamber outlet 24 of capsule 1 is inserted through hole 20 in disc 16 into inlet 9 and blind recess 9a until cap 25 rests on plug 11 as shown in FIG. 2 whereupon inlet skirt 10 and outlet skirt 30 closed by cap 25 are in co-operation and so locate chamber opening 24 in communication with container inlet 9. Force generated outside capsule 1 is then exerted on cover 21 in a direction which (as shown by Arrow A) is transverse of lid 6 and inwards of container 2. Exerting the force in this direction avoids loosening or removing lid 6. The force is transmitted by arm 34 via cap 25 to plug 11 whereupon plug 11 is disengaged and displaced from inlet skirt 10 as shown in FIG. 3 thereby opening closed inlet 9.

As shown in FIG. 4, further exertion of force on cover 21 urges chamber 23 against lid 6 whereupon a reaction from lid 6 is transmitted via disc 16 to lower dished portion 26b of chamber 23. The combined force and reaction causes a compression of chamber 23 and a contraction of the volume which contains colourant 3. Compression of chamber 23 causes a force to be transmitted by arm 34 which disengages and displaces cap 25 from chamber outlet 24 so creating an opening in chamber 23. Continuing compression of chamber 23 further contracts the volume containing colourant 3 and so positively expels colourant 3 via inlet 9 into container 2 as indicated by arrows B.

Yet further exertion of force on cover 21 causes the annular rib 27 on cover 21 to advance towards and engage flange 15 on lid 6 with a fluid-tight snap fit, so providing a replacement closure for inlet 9 which prevents spillage from container 2 via the clearance between outlet skirt 30 and inlet skirt 10. As rib 27 engages flange 15, upper dished portion 26a of chamber 23 approaches close to lower dished portion 26b and so positively expels most of the last drops of colourant 3 from chamber 23.

Finally the system may be subjected to mechanical shaking to disperse the introduced colourant 3 into paint 4. The forces which disengage and displace plug 11 and cap 25, which compress chamber 23 and which advance cover 21 into sealing engagement with flange 15 are conveniently generated by gripping capsule 1 and the base (not shown) of closed container 2 between opposed jaws of a mechanical shaker and tightening the grip.

FIG. 7 shows an alternative system in which a capsule 101 and a container 102 are modified (as compared with FIG. 1) so as to achieve better expulsion of colourant 103 from chamber 123.

Capsule 101 is modified by the presence of a circumferential bezel 121a around the perimeter of its circular rigid plastics cover 121. Bezel 121a enables cover 121 to make a close fit with upper dished portion 126a of the plastics foil of chamber 123. Container 102 is similarly modified by the presence of a bezel 106a on its lid 106 and around its closed inlet 109. As shown in FIG. 10, the presence of bezel 106a requires a shortening (as compared with FIG. 1) of radial troughs 114 which lead to catchment cavities 118.

As shown in FIG. 8, advancing capsule 101 towards container 102 causes concave curved portion 126d of lower dished portion 126b to roll upwards and inwards from the perimeter of chamber 123 so exerting a force on colourant 103 which positively propels colourant 103 towards central outlet 124.

As shown in FIG. 9, further advancement of capsule 101 sandwiches portions 126a and 126b of the plastics foil between now opposed bezels 121a and 106a so fully compressing chamber 123 and causing expulsion of virtually all of colourant 103. Full compression of chamber 123 also provides a gasket to assist good sealing of inlet 109 when rib 128 is engaged by groove 129.

Capsule 101 also employs a modified cap 125 and arm 134. The modification consists of providing a shed 134a which substantially reduces the amount of colourant 103 which can become trapped in top of cap 125.

Many members of the public dislike finding the arm 134 and the plug 111 immersed in the paint 104 in container 102. Accordingly FIGS. 11 and 12 show further modifications which prevent arm 134 and plug 111 from falling into paint 104.

As shown in FIG. 11, arm 134 is modified by the presence of a pair of barbs **134*b*. When capsule 101 is advanced towards container 102, barbs 134*b* become obstructed by upper perimeter 124*a* of chamber outlet 124 and therefore prevent arm 134 from falling into paint 104**.

Plug 111 is modified by the presence of a central crown **111*a* provided with a circumferential rib 111*b* which can make a snap fit into circumferential groove 134*c* formed in arm 134. Advancing arm 134 onto crown 111*a* causes rib 111*b* to engage groove 134*c* so that plug 111 is held by arm 134 and is prevented from falling into paint 104**.

FIG. 13 shows a modification to the capsule 101 as shown in FIG. 7. Capsule 101 is modified by employing a bellows **126*e* to define chamber 123 and the volume which contains colourant 103. Compression of bellows 126*e* provides an immediate positive expelling action which is useful with less flowable additives such as particulate solids. However bellows 126*e* is less suitable for use in the rapid expulsion of liquid colourants where the hydraulic pressure generated in the liquid may force the convex portions 126*f* of bellows 126*e* outwards causing the formation of a shape as shown in dashed lines in FIG. 13. Such a shape is less efficient at expelling residual colourant 103 from compressed chamber 123**.

FIG. 14 shows a different modification of capsule 101 in which chamber outlet 124 has a flanged distal edge 131 and is closed by a laminated disc frangibly welded onto edge 131 and comprising low density polyethylene coating 142, aluminum foil 141, cardboard insert 143 and polypropylene shield 140. Aluminum foil 141 provides an efficient water vapor barrier. Polyethylene coating 142 provides a material which bonds well to aluminum, is easily weldable to edge 131 and can protect foil 141 from corrosion by certain colourants. Cardboard insert 143 is adhesively bonded to both foil 141 and shield 140 and serves to stiffen foil 141. Polypropylene shield 140 serves to protect the laminated disc from accidental puncturing. In use sufficient hydraulic pressure can be generated in liquid colourant 103 to detach coating 142 from distal edge 131 and displace the laminated disc.

FIG. 15 shows an alternative capsule 201 containing liquid colourant 203 in a chamber 223 formed by relatively rigid dished cover portion 221 of capsule 201 and opposed dished injection molded polypropylene web 226. Web 226 is permanently spun welded at its outermost periphery **226*a* to cover 221 so giving chamber 223 a circumferential angled shape. Central outlet skirt 230 defining central chamber outlet 224 is molded integrally with web 226. Web 226 also has molded-in concave portion 226*b* adjacent its periphery 226*a* and molded-in hinge 226*c* (shown more clearly in FIG. 15*a*) formed by a thinning of web 226. Because of the good hinging properties of polypropylene, hinge 226*c* permits web 226 to flip inside out during compression of chamber 223 so that web 226 fits close to cover portion 221 as shown in FIG. 16. This close fit results in a virtually total contraction of the volume containing colourant 203. Hinge 226*c* is preferably located at a point some 45 to 85% of the distance from the center of chamber outlet 224 and the outer edge of periphery 226*a***.

FIG. 17 shows a modification capsule 201 of the type shown in FIG. 15. Capsule 201 has a modified closure comprising a disc 241 of aluminum foil frangibly adhesively bonded to the distal edge 231 of outlet skirt 230 and a plug 240 trapped against a circular rib 243 of skirt 230. Plug 240 supports disc 241 in resisting damage by finger nails and the like.

Figure 18:
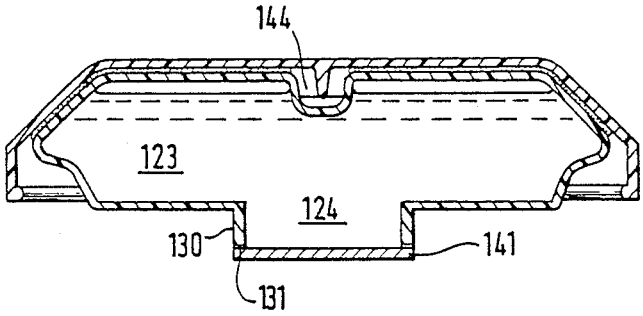

FIGS. 18 to 22 show further alternative closures for the chamber outlet. In FIG. 18, the closure consists of a simple disc 141 of aluminum foil frangibly adhesively bonded to distal edge 131 of outlet skirt 130. Disc 141 is disengaged and displaced by hydraulic pressure generated on compressing the capsule. The capsule is provided with a dependent cruciform projection 144.

Figure 19:
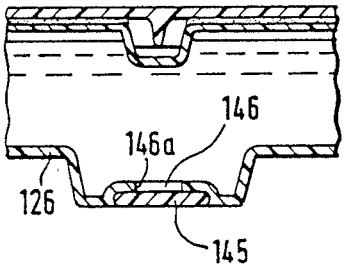

FIG. 19 shows a closure comprising a circular plug 145 adhesively bonded to the circumference of a hole 146 cut into plastics foil or web 126. Such a closure is cheap to make.

Figure 20:
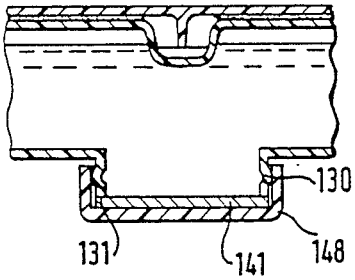

FIG. 20 shows a closure comprising a disc 141 of aluminum foil frangibly adhesively bonded to distal edge 131 of outlet skirt 130 and covered by a cap 148 snap-fitted onto skirt 130. Cap 148 protects disc 141 against damage by finger nails or sharp objects. The strength of the adhesive bond and the closeness of the snap-fit are chosen so as to allow detachment and displacement of the closure by hydraulic pressure generated by compression of the capsule.

FIG. 21 shows a closure comprising a circular plug 149 integrally hinged over a short distance of its circumference to a ring 150 provided with an internal rib 151. Ring 150 is spun welded to outlet skirt 130 and plug 149 is trapped against rib 151 by a simple disc 141 of aluminum foil frangibly adhesively bonded to skirt 130. Hydraulic pressure generated on compressing the capsule disengages and displaces disc 141 and also causes plug 149 to hinge downwardly. The advantage of this form of closure is that plug 149 is available to assist disc 141 in resisting damage by finger nails or the like yet plug 149 does not fall into the paint being tinted because it is retained by its hinge. If a more robust closure is needed, simple disc 141 may be replaced by a laminated disc of the type shown in FIG. 14.

FIG. 22 shows a closure comprising a cruciform plug 152 which is welded to outlet skirt 130 and which abuts against upper dished portion **126*a* of chamber 123 and indirectly against top portion 121 of the capsule. Plug 152 is located centrally by dependent projection 144. The advantage of plug 152 is that it is directly disengageable and displaceable by a force exerted downwards on top portion 121**.

FIGS. 23 and 24 show a system comprising a capsule together with a lid of a container wherein the capsule has a chamber outlet closed by permanently bonded aluminum foil and the lid is provided with a sharp tool for rupturing the foil to create an opening in the chamber. FIG. 23 shows a capsule 101 of the type described with reference to FIG. 18 and the central portion of a lid 106 in place on a container (not shown) as described with reference to FIG. 7 except that the inlet closure 311 is modified by the presence of a central upstanding cruciform polypropylene spike 300. Chamber outlet 124 of capsule 101 is closed by disc 141 of permanently adhesively bonded aluminum foil. On advancing capsule 101 towards lid 106, spike 300 ruptures disc 141 so creating an opening in chamber 123. This system provides a very positive rupturing of the aluminum foil but has the disadvantage of creating the opening in chamber 123 momentarily before the inlet in 106 is opened and hence capsule 123 must be advanced quickly onto lid 106 if a slight spillage of colourant is to be avoided.

FIG. 24 shows a capsule 401 together with the central portion of a lid 106 in place on a container (not shown) as described with reference to FIG. 7 except that lid 106 has a modified inlet closure arrangement. The modified inlet closure arrangement comprises a blind end 440 to inlet skirt 410. Blind end 440 contains a central hole 445 around which is mounted an upstanding hollow angled cylindrical metal blade 400 in the recess 409 defined by skirt 410. The inlet closure itself comprises a polypropylene plug 411 which makes a snap-fit into inlet skirt 410 and contains a central hole 446 closed by disc 447 of aluminum foil permanently adhesively bonded to plug 411. Capsule 401 contains a chamber 423 having an outlet skirt 430 leading to a chamber outlet 424 closed by disc 441 of permanently adhesively bonded aluminum foil. On advancing capsule 401 towards lid 106, outlet skirt 430 disengages plug 411 from its snap-fit and displaces it downwards whereupon foil disc 447 and subsequently foil disc 441 are ruptured by blade 400 so creating openings in lid 106 and chamber 423 respectively. On compression of chamber 423, colourant 403 is expelled through the newly created openings via hollow blade 400 and hole 445 into the container beneath lid 106. Blade 400 may alternatively be made of plastics material.

The top wall of chamber 423 is provided with a dependent circular indentation 444 having a T-shaped cross-section. Indentation 444 helps to guide colourant 403 towards chamber outlet 409 and to seal hole 445 when chamber 423 is fully compressed.

An advantage of the system shown in FIG. 24 is that avoids closures falling into the paint.

FIG. 25 shows an outlet closure 540 and an inlet closure 511 which nave been modified so as to be mutually engageable so that only a single closure item will be found in the tinted paint. Outlet closure 540 is modified by the presence of a dependent circular "L" shaped lip 541 which is snap-engageable with an upstanding grooved rim 512 provided on inlet closure 511. As a capsule is advanced onto a container, lip 541 snap-fits into rim 512 so uniting the closures into a single item.

This invention also provides a capsule comprising (a) a (preferably compressible chamber which houses a volume which contains flowable additive for a paint, varnish, woodstain or the like and in which chamber an opening can be created, (b) means for positively expelling additive from the chamber through the opening in response to the application of a force on the capsule and (c) locating means co-operable with locating means on a closed container so as to at least assist in locating an opening created in the chamber in communication with an inlet in the container.

Preferably, the means for positively expelling additive from the chamber is responsive to a force which, when the capsule is located on a container, is directed inwards of the container. It is also preferred that the capsule comprises means for creating the opening in the chamber and that this means should be responsive to a force on the capsule acting in the same direction as the force to which the positive expulsion means is responsive.

The invention further provides for use in a system according to this invention, a container comprising an inlet closed by a closure, but which inlet is openable by a force exerted on the closure in a direction inwards of the container and which container is also provided with locating means co-operable with locating means on a capsule so as to at least assist in locating the inlet in communication with an opening in a capsule containing additive.

This invention further provides a method for introducing flowable additive to paint, varnish, woodstain or the like in a closed (preferably lidded) container which method comprises (a) placing a capsule comprising a chamber which houses a volume which contains additive in contact with the closed container which container has an inlet closed by a closure, (b) opening the inlet by means of a force exerted on the closure (c) creating an opening in the chamber which opening communicates with the inlet, (d) positively expelling additive through the opening into the opened inlet by contracting the volume which contains the additive and then (e) preferably creating a seal between the capsule and the container whereby spillage from the otherwise open inlet can be prevented.

What we claim is

1. A closed container containing paint, varnish, woodstain or the like for use in a system employed to introduce a flowable additive from a capsule into the container, wherein the container comprises (a) an inlet closed by a closure which is displaceable into the container to open the container, (b) a bezel extending around the inlet, and (c) co-operable sealing means for co-operating with co-operable sealing means on a capsule to provide a replacement closure for the inlet so as to prevent spillage from the container after the inlet closure has been displaced which sealing means is located around and is spaced from the inlet and is located below the bezel whereby the bezel can be used as a surface for supporting a gasket.

2. A container as claimed in claim 1 wherein the inlet is openable by a force exerted on the closure in a direction inwards of the container so as to displace the closure.

3. A container as claimed in claim 1 wherein the container is closed by a lid and the inlet is formed in the lid.

4. A container as claimed in claim 1 wherein the co-operable sealing means is able to receive a suitably dimensioned co-operable sealing means with a snap or push fit.

5. A container as claimed in claim 3 wherein the co-operable sealing means comprises a groove extending around the inlet.

6. A container according to claim 11 wherein the container is provided with locating means co-operable with locating means on a capsule so as to at least assist in locating inlet in communication with an opening in the capsule.

7. A container according to claim 6 wherein the locating means co-operable with locating means on a capsule comprises a recess for receiving a projection dependent from a capsule.

8. A container according to claim 7 wherein the recess is defined by a skirt extending inwardly of the container and which is closed by a closure located at the distal end of the skirt.

9. A container according to claim 8 wherein the closure makes a snap-fit with the distal end of the skirt.

10. A container according to claim 1 wherein a force of at least 0.05 kN is required to open the container inlet.

11. A container according to claim 1 wherein the inlet is closed by a closure integral with the inlet.

12. A container according to claim 1 wherein the inlet is closed by a closure formed separately from inlet and which is engaged by the inlet by means which permit disengagement and displacement of the closure from the inlet in a pre-determined way.

13. A container according to claim 12 wherein the inlet engages the closure by means of a snap fit.

14. For use in a system employed to introduce flowable additive from a capsule into paint, varnish, woodstain or the like, a closed container which contains paint, varnish, woodstain or the like, which is closed by a lid and which comprises:

an inlet formed in the lid and closed by a closure, wherein (a) the closure is displaceable inwardly of the container whereby the inlet is openable by a force exerted on the closure in a direction inwards of the container so as to inwardly displace the closure, and (b) the container is provided with sealing means for cooperating with co-operable sealing means on a capsule to provide a snap-fit replacement closure for the inlet so as to prevent spillage from the container after the inlet closure has been displaced.

15. A container as claimed in claim 14 wherein the sealing means provided on the container is spaced from and extends around the inlet.

16. A container according to claim 14 wherein the lid is provided with a bezel around the inlet and the sealing means provided on the container comprises a groove located below the bezel whereby the bezel can be used as a surface for supporting a gasket.

* * * * *